US008897419B1

(12) United States Patent
Jacob

(10) Patent No.: US 8,897,419 B1
(45) Date of Patent: Nov. 25, 2014

(54) SYSTEMS AND METHODS FOR ACCELERATING CHARGED PARTICLE BEAMS

(75) Inventor: Jonah H. Jacob, Brookline, MA (US)

(73) Assignee: Science Research Laboratory, Inc., Somerville, MA (US)

( * ) Notice: Subject to any disclaimer, the term of this patent is extended or adjusted under 35 U.S.C. 154(b) by 334 days.

(21) Appl. No.: 13/372,763

(22) Filed: Feb. 14, 2012

Related U.S. Application Data

(60) Provisional application No. 61/442,460, filed on Feb. 14, 2011.

(51) Int. Cl.
*H01J 35/04* (2006.01)
*H01J 27/02* (2006.01)
*H01J 29/46* (2006.01)

(52) U.S. Cl.
USPC ..... 378/126; 250/423 R; 250/492.3; 313/146; 313/293

(58) Field of Classification Search
USPC ..... 378/122, 126, 135, 137, 138; 250/423 R, 427, 492.3; 313/146, 230, 313/291, 293, 294, 359.1; 315/500, 506, 315/507
See application file for complete search history.

(56) References Cited

U.S. PATENT DOCUMENTS

| | | | | |
|---|---|---|---|---|
| 3,714,486 | A | 1/1973 | McCrary | |
| 5,517,545 | A * | 5/1996 | Nakamura et al. | 378/101 |
| 5,629,969 | A | 5/1997 | Koshishiba | |
| 5,867,556 | A * | 2/1999 | Snyder et al. | 378/127 |
| 6,553,096 | B1 | 4/2003 | Zhou et al. | |
| 7,436,931 | B2 | 10/2008 | Harding | |
| 7,486,772 | B2 | 2/2009 | Lu et al. | |
| 7,551,722 | B2 | 6/2009 | Ohshima et al. | |
| 7,649,980 | B2 | 1/2010 | Aoki et al. | |
| 2002/0196894 | A1 * | 12/2002 | Launay et al. | 378/8 |
| 2004/0228450 | A1 * | 11/2004 | Mueller | 378/199 |
| 2004/0240618 | A1 * | 12/2004 | McGuire | 378/137 |
| 2007/0114434 | A1 | 5/2007 | Chang et al. | |
| 2008/0043920 | A1 | 2/2008 | Liu et al. | |
| 2008/0170668 | A1 | 7/2008 | Kruit et al. | |
| 2010/0290593 | A1 * | 11/2010 | Legagneux et al. | 378/122 |
| 2011/0228898 | A1 * | 9/2011 | Pelc et al. | 378/9 |

FOREIGN PATENT DOCUMENTS

| | | | |
|---|---|---|---|
| JP | 2003036805 | A | 2/2003 |
| WO | WO 2009092813 | A1 * | 7/2009 |

OTHER PUBLICATIONS

Hong, C.-Y. et al. Temporal and Spatial Current Stability of Smart Field Emission Arrays, IEEE Transactions on Electron Devices, vol. 52, No. 10, Oct. 2005, 2323-2328.

Liu, Z. et al. Carbon nanotube based microfocus field emission x-ray source for microcomputed tomography, Applied Physics Letters 89, Oct. 31, 2011 (2006), 103111-1-103111-3.

* cited by examiner

*Primary Examiner* — Glen Kao
(74) *Attorney, Agent, or Firm* — Burns & Levinson LLP; Orlando Lopez

(57) ABSTRACT

Embodiments of micro-x-ray sources and methods for obtaining a micro-x-ray source are disclosed.

21 Claims, 8 Drawing Sheets

SYSTEMS AND METHODS FOR ACCELERATING CHARGED PARTICLE BEAMS

CROSS REFERENCE TO RELATED APPLICATIONS

This application claims priority to U.S. Provisional Application Ser. No. 61/442,460, filed Feb. 14, 2011, entitled SYSTEMS AND METHODS FOR CONVERTING/STORING ENERGY WITH APPLICATION TO GENERATING MICRO X-RAY SOURCES, which is incorporated by reference herein in its entirety and for all purposes.

BACKGROUND

This invention relates generally to methods and systems for accelerating charged particle beams and to applications of those methods and systems. Among the applications are application to x-ray sources, and, more particularly, to micro-x-ray sources.

The storing of electrical energy has seen application in pulsed power systems and in other power systems. In one well-known example, in work initiated by J. C. Martin of AERE (UK), energy storage in capacitors has been used for the generation of electron beams. While such initial work was aimed at very large systems, there is a need for technology that relates to the storing/converting electrical energy but is applicable to small systems.

X-ray radiation has been widely used in imaging applications such as, but not limited to, medical diagnosis, security screening, industrial inspection (including material-stress studies), DNA structure studies, geophysical studies and in lithography. Reduction of the x-ray focal spot size can result in an increase in spatial resolution resulting in greater coherence.

Carbon nanotubes have been used as cathodes in some micro-x-ray sources. Carbon nanotubes have a lower threshold electric field for emission but still require large voltages for operation and could require a higher expense in manufacturing.

There is a need for x-ray micro-sources that can operate at relatively low voltages and use conventional materials.

There is also a need for low-cost, small format systems and methods for accelerating charged particles.

BRIEF SUMMARY

Embodiments of systems and methods for accelerating charged particles are disclosed. As an exemplary application, embodiments of micro-x-ray sources and methods for obtaining a micro-x-ray source are disclosed.

In one or more embodiments, the apparatus of these teachings includes a first conducting structure that acts as a charged particle source or has the capability of emitting charged particles, an second conducting structure, a grid disposed between the second conducting structure and the first conducting structure, the anode structure and the grid forming a capacitive structure, a charging component configured to charge the capacitive structure and a motion subsystem configured to effect a displacement between the second conducting structure and the grid.

One or more embodiments of the method of these teachings for obtaining an accelerated charged particle beam includes providing a device including a first conducting structure that acts as a charged particle source, a second conducting structure, a grid disposed between the second conducting structure and the first conducting structure, the second conducting structure and the grid forming a capacitive structure, a charging component configured to charge the capacitive structure, and a motion subsystem configured to effect a displacement between the second conducting structure and the grid, charging the capacitive structure, increasing a distance between the second conducting structure and the grid, and causing charged particle emission from the first conducting structure.

Other embodiments of the method and system are also disclosed.

For a better understanding of the present teachings, together with other and further objects thereof, reference is made to the accompanying drawings and detailed description and its scope will be pointed out in the appended claims.

DETAILED DESCRIPTION

Figure 1A:
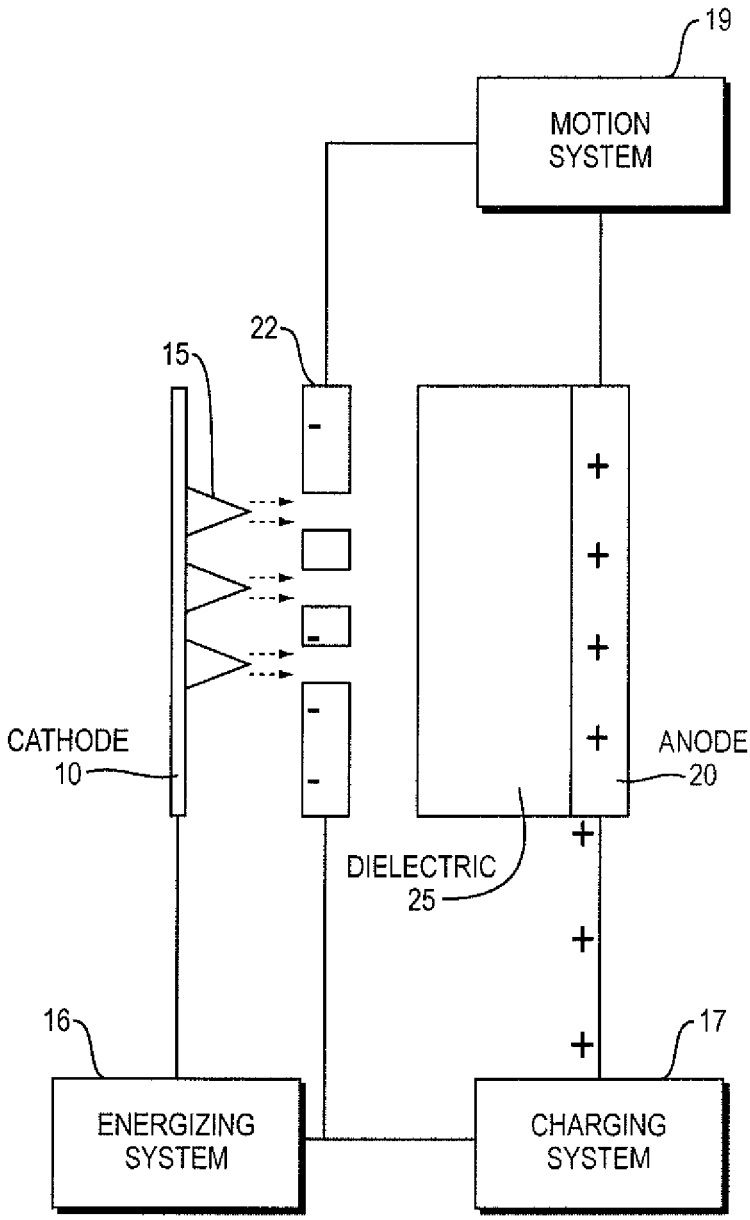
FIGS. 1*a* and 1*b* are graphical pictorial representations of embodiments of these teachings.

The following detailed description is of the best currently contemplated modes of carrying out these teachings. The description is not to be taken in a limiting sense, but is made merely for the purpose of illustrating the general principles of these teachings, since the scope of these teachings is best defined by the appended claims. Although the teachings have been described with respect to various embodiments, it should be realized these teachings are also capable of a wide variety of further and other embodiments within the spirit and scope of the appended claims.

As used herein, the singular forms "a," "an," and "the" include the plural reference unless the context clearly dictates otherwise.

Except where otherwise indicated, all numbers expressing quantities of ingredients, reaction conditions, and so forth used in the specification and claims are to be understood as being modified in all instances by the term "about."

Embodiments of systems and methods for accelerating charged particles are disclosed hereinbelow. As an exemplary application, embodiments of micro-x-ray sources and methods for obtaining a micro-x-ray source are disclosed.

"Motion system", as used herein, refers to a component that provides motion to another component.

In one or more embodiments, the apparatus of these teachings includes a first conducting structure that acts as a charged particle source or has the capability of emitting charged particles, a second conducting structure, a grid disposed between the second conducting structure and the first conducting structure, the second conducting structure and the grid forming a capacitive structure, a charging component configured to charge the capacitive structure and a motion subsystem configured to effect a displacement between the second conducting structure and the grid.

In embodiments where the charged particles are electrons, the first conducting structure includes a cathode structure and the apparatus also has an energizing component (such as a component imposing a predetermined voltage between the cathode structure and the grid) causing electron emission between the cathode structure and the grid or/and accelerating electrons emitted from the cathode structure.

During operation, the charging sub-system charges the capacitive structure by applying a voltage between the grid and the second conducting surface;

the charging voltage is removed; and the distance between the second conducting surface (or second conducting surface/dielectric) and the first conducting surface (or first conducting surface/dielectric) is increased causing the voltage in the space between the first conducting surface and the second conducting surface/dielectric (or, in another embodiment, between the second conducting surface and the first conducting surface/dielectric structure to increase.

The exemplary embodiment of an application to a micro-x-ray source is presented in detail below.

In one embodiment, the micro-x-ray source of these teachings includes an anode, at least a portion of the anode acting as a target when the structure operates as a micro-x-ray source, a cathode that acts as an electron source when the structure operates as a micro-x-ray source, a grid disposed between the anode and the cathode, the anode and the grid forming a capacitive structure, a charging component charging the capacitive structure and a motion system displacing the anode relative to the grid or the grid relative to the anode.

Another embodiment includes a dielectric disposed between the anode and the grid, the dielectric being disposed on the anode, in one instance, or on the grid, in another instance. In embodiments including the dielectric disposed between the anode and the grid, the capacitive structure also includes the dielectric.

It should be noted that there may be embodiments of these teachings that does not need a triode (three electrodes-cathode, grid and anode) arrangement. Also, there may be embodiments of these teachings that have other electrodes in addition to the grid.

It should also be noted that embodiments of these teachings in which the dielectric is absent are also within the scope of these teachings.

One or more embodiments of the method of these teachings for obtaining an accelerated charged particle beam includes providing a device including a first conducting structure that acts as a charged particle source, a second conducting structure, a grid disposed between the second conducting structure and the first conducting structure, the second conducting structure and the grid forming a capacitive structure, a charging component configured to charge the capacitive structure, and a motion subsystem configured to effect a displacement between the second conducting structure and the grid, charging the capacitive structure, increasing a distance between the second conducting structure and the grid, and causing charged particle emission from the first conducting structure.

The exemplary embodiment of an application to a micro-x-ray source is presented in detail below. In those exemplary embodiments, the charged particles are electrons, the first surface is a cathode and the second surface is an anode. In some exemplary embodiments, a dielectric is disposed between the grid and the anode.

In one embodiment, in the initial configuration, the spacing between the anode and the grid is very small, about 0.1 μm in one instance (these teachings not being limited to only that instance). In embodiments including a dielectric disposed between the anode and the grid, the spacing between the anode with the dielectric disposed on the anode and the grid, or between the grid with the dielectric disposed on the anode and the anode, is also very small, about 0.1 μm in one instance (these teachings not being limited to only that instance). The capacitive structure is charged by applying a voltage between the anode and the grid. The charging voltage is removed. The anode structure is then moved away from the grid, or the grid structure is then moved away from the anode, causing the voltage in the space between the grid and the anode to increase. In embodiments including a dielectric, increasing the spacing between the anode/dielectric structure and the grid, in one instance, or in the spacing between the anode and the grid/dielectric structure, in another instance, causes the voltage in the space between the structure with the dielectric and the other surface to increase. The voltage of the cathode with respect to the grid is rendered negative, causing the cathode to emit.

One embodiment of the micro-x-ray source of these teachings is shown in FIG. 1*a*. Referring to FIG. 1*a*, the embodiment shown therein includes;

a cathode 10, which acts as an electron source when the structure operates as a micro-x-ray source, an anode 20, at least a portion of which acts as a target when the structure operates as a micro-x-ray source, a dielectric 25 disposed on the anode 20, a cathode 10 that acts as an electron source when the structure operates as a micro-x-ray source, a grid 22 disposed between the anode 20 and the cathode 10, the dielectric 25 being disposed between the anode 20 and the grid 22; the anode 20, the dielectric 25 and the grid 22 forming a capacitive structure, a charging system 17 for charging the capacitive structure a motion system 19 for displacing the anode/dielectric relative to the grid and an energizing system 16 causing electron emission between the cathode and the grid or/and accelerating electrons emitted from the cathode.

Figure 1B:
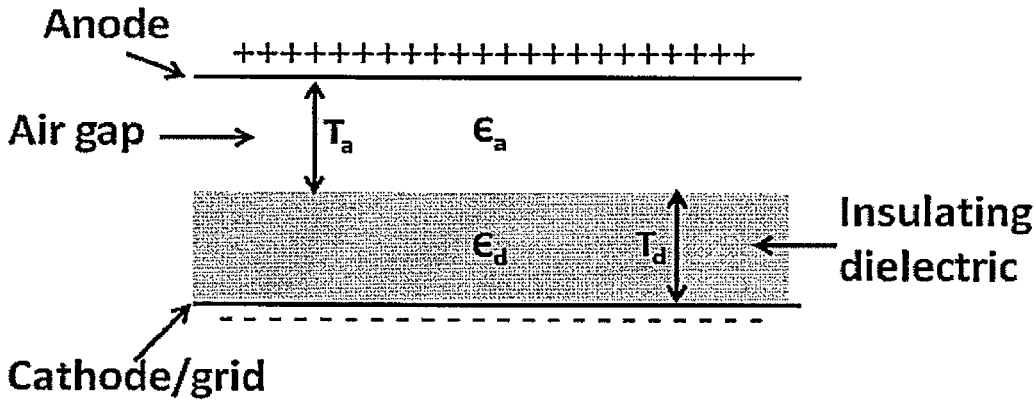

FIG. 1*b* shows the capacitive structure for the embodiment in which the dielectric 25 is disposed on the grid 22. In the embodiment of FIG. 1 *b*, the motion system 19 increases the distance between the grid/dielectric and the anode 20.

In one instance, the charging system 17 includes a battery.

In one instance, operation of the system is as follows:

the capacitive structure formed by the anode/dielectric 20, 25 and the grid 22 is charged by applying a voltage between the anode 20 and the grid 22, the charging voltage is removed, the anode/dielectric structure 20, 25 is then moved away from the grid 22 causing the voltage in the space between the grid and the anode/dielectric structure to increase, At predetermined time when the voltage across the space between the grid and the anode/dielectric structure is approximately a predetermined value, the voltage of the cathode with respect to the grid is rendered negative, causing the cathode to emit. The electron emission can also be triggered by electronics as discussed hereinbelow (see Ching-Yin Hong, Akintunde Ibitayo Akinwande, Temporal and Spatial Current Stability of Smart Field Emission Arrays, IEEE Transactions on Electron Devices, Vol. 52, NO. 10, October 2005, pp. 2323-2328, which is incorporated herein is entirety for all purposes) and presented in FIG. 2.

Although the above description refers to the instance in which a dielectric is disposed on the anode, similar operation occurs when the dielectric is disposed on the grid or what the dielectric is absent.

In one instance, the charging system 17 includes a battery.

It should be noted that embodiments in which the anode is grounded are within the scope of these teachings.

While the system shown in FIG. 1 (hereinafter referred to as an "elemental x-ray source") depicts only one x-ray source, other embodiments include an array of x-ray sources. (Those embodiments can be constructed utilizing the embodiment shown in FIG. 1 as a building block.) The array of x-ray sources allows for utilization of different materials and different initial voltages resulting in a versatile x-ray source.

Very compact embodiments of the x-ray source of these teachings can be achieved. In one exemplary embodiment, not a limitation of these teachings, the x-ray source has a volume less than 0.01 cu. ft. (0.01 $ft.^3$).

Embodiments of the x-ray source of these teachings are more efficient than conventional x-ray sources. In one exemplary embodiment, not a limitation of these teachings, the x-ray source has an efficiency of more than 10 times the efficiency of conventional sources. Since the x-ray source can be placed closer to the object to be imaged and the imaging diagnostic, one can use a larger fraction of x-ray photons emitted resulting in a higher efficiency. It should also be noted that embodiments of these teachings in which the dielectric is absent are also within the scope of these teachings. Those embodiments can be described by the Figures if the thickness of the dielectric is taken to be zero.

Embodiments of these teachings utilizing an array (or spatial matrix) of x-ray sources reduce the heat flux that needs to be removed. In some embodiments the reduction in waste heat flux is greater than 10, 100, 1,000 and greater than that of conventional embodiments. Reduction in waste results in a decrease cooling required for the anode and eliminates other complications in anode design.

Figure 5:
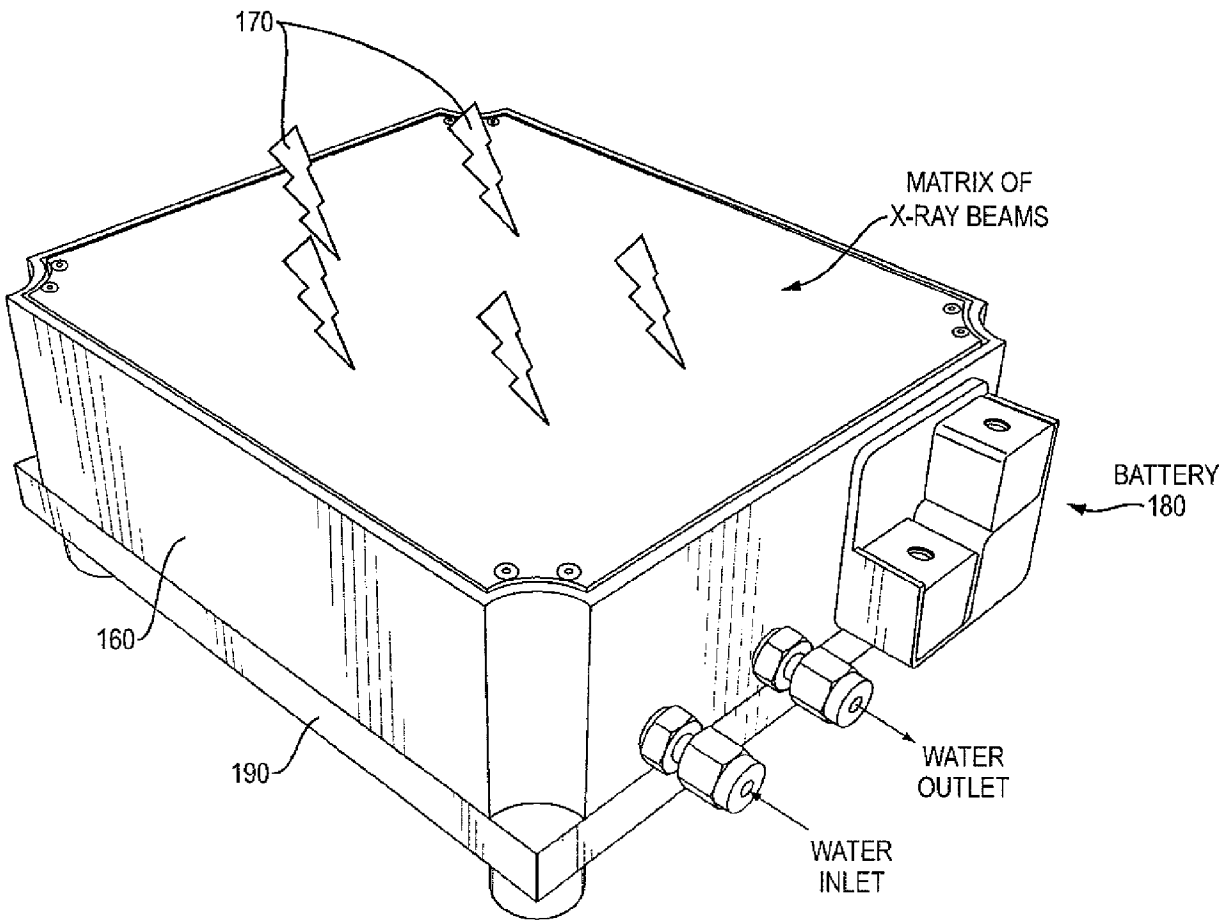
FIG. 5 is graphical representation of an exemplary x-ray spectrum as produced by an embodiment of the system of these teachings.

One embodiment of the system of these teachings includes an enclosure (housing) inside which the array of x-ray sources is located, as shown in FIG. 5. Referring to FIG. 5, the embodiment shown therein has an enclosure 160 that houses an array (matrix) of x-ray sources. The array of x-ray sources produces the array of x-ray beams 170. Disposed on the housing 160 is a receptacle and operative connection 180 for a battery used to charge the capacitive structure in each of the x-ray sources. A cooling device 190, such as, but not limited to a microchannel cooling device is operatively connected to the housing 160. Micro-channel cooling, in one instance, can ensure that the temperature of the outer casing 160 will not exceed a predetermined temperature, in one exemplary instance 45° C.

Figure 6:
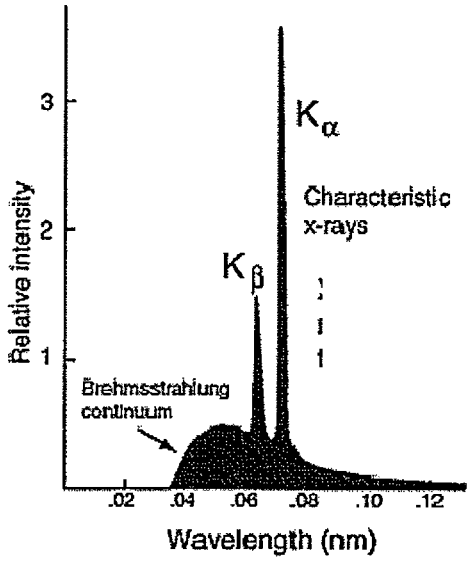
FIG. 6 is a graphical representation of an exemplary x-ray spatial distribution as produced by an embodiment of the system of these teachings.
Figure 7:
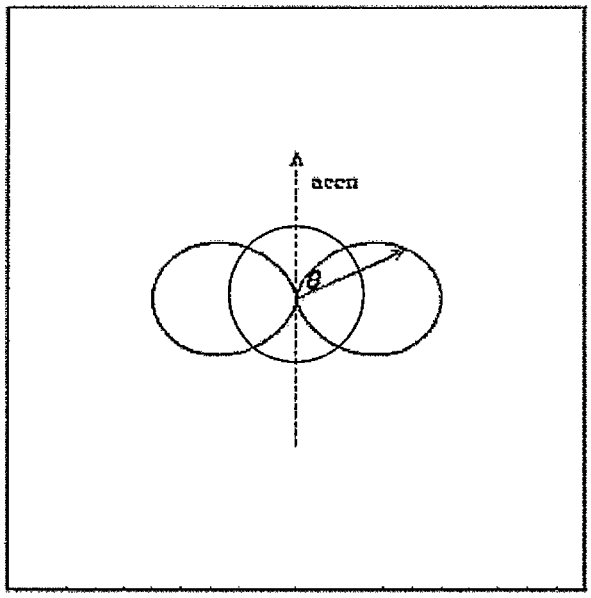
FIG. 7 is a graphical pictorial representation of an embodiment of the system of these teachings.

The material of the anode 20 can be selected so that x-ray lines (such as, but not limited to, K shell lines) are excited. The x-ray spectrum in that instance can include both the radiation due to electron slowing down (so called "bremsstrahlung" radiation) and line radiation. By changing anode materials the K-edge photon energy will change providing tunability. Having an array of cathode/anode materials allows utilizing x-ray subtraction to improve the quality of the image of the object being illuminated. An exemplary instance of the x-ray spectrum is shown in FIG. 6. The spatial distribution of the x-ray line radiation, as shown in FIG. 7, does not exhibit the anisotropy, two lobes oriented perpendicular to the direction of electron acceleration (or deceleration)). Due to this difference in the spatial distribution of the line radiation and to the narrow line with, embodiments in which subtraction and phase coherence are utilized to enhance resolution are within the scope of these teachings. (For phase coherence, see for example, A phase and space coherent direct imaging method, J. Acoust. Soc. Am. Volume 125, Issue 1, pp. 227-238 (January 2009) and Antonio Leonardo Damato, Capabilities and Limitations of Phase Contrast Imaging Techniques With X-Rays and Neutrons, PhD thesis, Nuclear Science and Engineering, MIT, February 2009, both of which are Incorporated by reference herein in their entirety and for all purposes; for subtraction, see, for example, Robert A. Kruger, et al., Digital K-Edge Subtraction Radiography, October 1977 Radiology, 125, 243-245, which is incorporated by reference herein in its entirety for all purposes). The small extent of the spot size in embodiments of the present teachings also contributes to the enhanced resolution. In some exemplary instances the resolution is about 10 μm or less.

Embodiments of the x-ray source of these teachings that are very compact and small in physical dimension can be assembled in an array of x-ray sources. Each of the elements of such an array subtends a large solid angle with respect to the object being illuminated. Due to the large solid angle subtended by each element of the array, depth resolution can be obtained for an image of an object being illuminated by the array of x-ray sources. Also due to the large solid angle subtended by each element of the array, image subtraction can be applied to enhance the image or obtain depth resolution.

Other details of one embodiment of the x-ray source of these teachings are presented hereinbelow.

In one instance the cathode 10 has at least a film with a layer of electron field emitting material(s). In one embodiment, at least a portion of the surface of the cathode 10 is electrically conducting. (Embodiments in which the entire cathode is electrically conducting also within the scope of this teachings.) Embodiments in which the entire cathode consists of electron field emitting material(s) are also within the scope of these teachings. In the embodiment shown in FIG. 1*a*, the field emitting surface of the cathode 10 is patterned 15 in order to better promote electron field emission. An anode 20, at least a portion of which acts as a target when the structure operates as a micro-x-ray source, is operatively disposed apart from the cathode 10 and grid 22 to enable electrons from the electron source at the cathode to reach the target located substantially at the anode. In the embodiment shown in FIG. 1*a*, a dielectric structure 25 is disposed on at least a portion of the surface of the anode 20. Although the dielectric structure 25 is shown as a solid structure, embodiments in which the dielectric structure is a patterned structure, in order to enable electrons to reach the target and generate x-rays or/and in order to promote focusing of the electron stream, are also within the scope of these teachings. In most embodiments, the space between the cathode 10, the grid 22 and the anode 20 (or between the cathode 10, the grid 22 and the dielectric structure 25) is substantially evacuated, so that electrons, when field emission occurs, can travel substantially without collisions from the cathode 10 to the anode 20. The grid 22 and the anode 20 (including, in one instance, the dielectric structure 25) form a capacitive structure. A voltage applied between the cathode 10 and the grid 22, applied by a charging system 17, can charge the capacitive structure. A controller and/or a switch can remove the voltage, resulting in a charge capacitive structure (also referred to as a capacitor). The anode 20 can be displaced relative to the grid 22. A motion system 15 enables the displacement between the anode 20 and the grid 22. The motion system 19 can be controlled by the controller. A variety of embodiments, such as, but not limited to, a stepper motor, a "voice coil" motor and actuator (such as that used in magnetic disk drive), magnetic/electromagnetic actuator (such as a "voice coil" motor), a lead screw and a motor, a ball screw and motor, a belt, a piezoelectric crystal and motor system, a piezoelectric actuator (such as Squiggle™ motors, see, "Linear Actuator", EO Magazine, p. 36, March 2004, incorporated by reference herein in its entirety and for all purposes) can be used to effect the displacement of the anode 20 relative to the grid 22.

It should be noted that there a number of possible embodiments for charging the capacitive structure. A voltage source controlled by a controller component can provide a voltage for a predetermined period of time in order to charge the capacitive structure. Similarly, a voltage source and a switch controlled by a controller component (such as a computer) can also be used.

In another embodiment, the cathode/grid structure also includes a MOSFET structure, wherein the cathode comprises the MOSFET drain.

Figure 2:
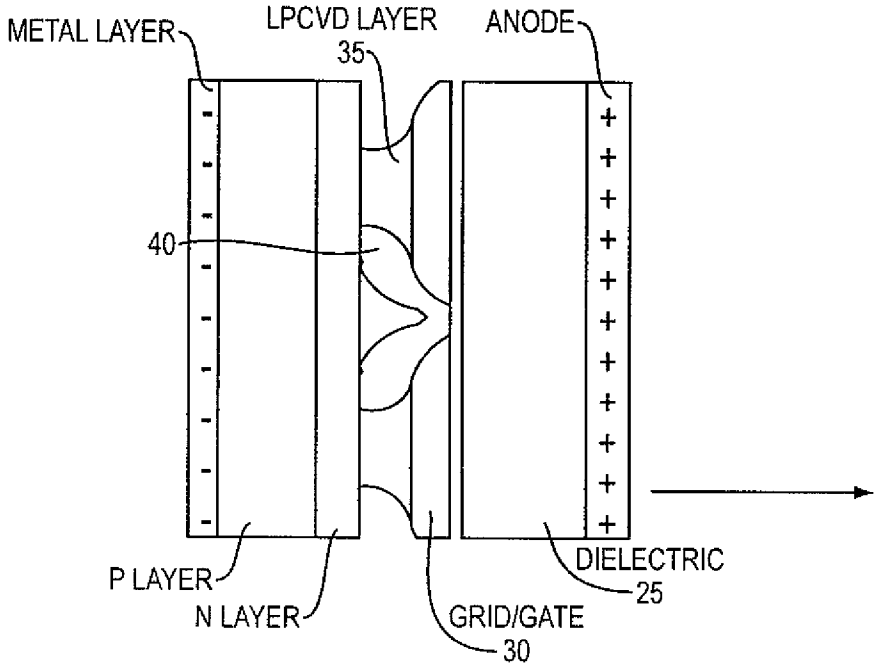
FIG. 2 is a graphical pictorial representation of another embodiment of these teachings.
Figure 3:
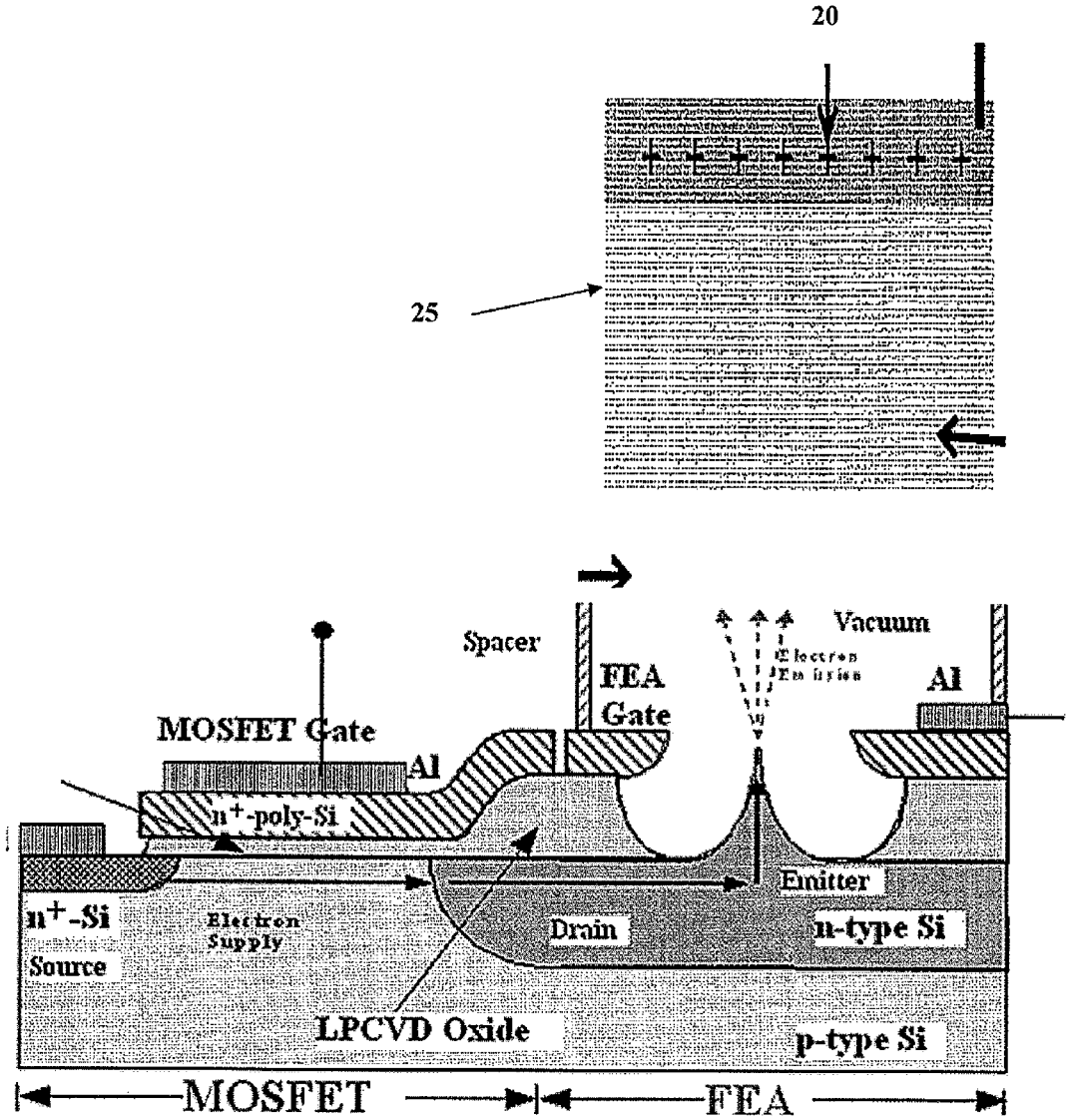
FIG. 3 is a graphical pictorial representation of another embodiment of these teachings.

Another embodiment of the system of these teachings is shown in FIG. 2. in the embodiment shown therein, the cathode also includes a MOSFET structure, as described in Ching-Yin Hong, Akintunde Ibitayo Akinwande, Temporal and Spatial Current Stability of Smart Field Emission Arrays, IEEE Transactions on Electron Devices, Vol. 52, NO. 10, October 2005, pp. 2323-2328, which is incorporated herein is entirety for all purposes. Referring to FIG. 2, in the embodiment shown therein, the cathode/MOSFET structure includes a MOSFET gate/grid 30 disposed on an oxide layer 35, the oxide layer being disposed between the MOSFET gate and the cathode 40, where the cathode comprises the MOSFET drain. The MOSFET drain is a lightly doped drain in order to reduce the drain electric field. It should be noted that although in FIG. 2 the cathode 40 is shown as having a single feature pattern, this is not a limitation of these teachings. The fabrication of MOSFET structures is conventional. One example of the method for fabrication of such a MOSFET/cathode structure is given in C. Y. Hong and A. I. Akinwande, "A silicon MOSFET/field emission array fabricated using CMP," J. Vac. Sci. Technol. B, Microelectron. Process. Phenom., vol. 21, no. 1, pp. 500-505, 2003. The combined MOSFET/cathode structure results in improved emission current stability and spatial uniformity of the field emission. By using such a cathode arrangement the pulse width of the electron beam can be controlled. Such a control could be helpful in maintaining the grid/anode voltage at a substantially constant voltage thereby insuring x-ray photons emitted are better controlled. A more detailed view of the embodiment in which the cathode also includes a MOSFET structure, is shown in FIG. 3. The charging system and the motion system are not shown in FIGS. 2 and 3, but are part of a system and they are connected in a manner similar to that of FIG. 1.

At least a portion of the cathode, the field emitting surface, can include materials such as, but not limited to, molybdenum (Mo), silicon (Si), diamond (e.g., defective CVD diamond, amorphous diamond, cesium-coated diamond, a nano-diamond), and graphite powders.

At least a portion of the anode, the X-ray emitting portion, can include materials such as, but not limited to, copper, molybdenum, silver, and tungsten.

Other materials can be selected so that x-ray lines (such as, but not limited to, K shell lines) are excited. X-ray line-widths as small as 0.03% between 10 and 80 keV can be obtained. Such narrow lines are produced when the electron beam excites the K-shell of atoms, with energy ranging, for example, from 12 keV for Br to 82 keV for Pb. It should be noted that the material can also include compounds, such as oxides, of the basic materials selected.

Although the anode in FIG. 1*a* is shown as operating in the transmission mode, that is not a limitation of these teachings.

During operation of the system of these teachings, before field emission initiates, the initial closest spacing between the anode 20 and the grid 22 is small (in one embodiment, these teachings not be limited only to that embodiment, about 10 μm or less; in another embodiment about 0.1 μm or less). A small voltage (in one embodiment, these teachings not be limited only to the embodiment, about 1000 V or less; in another embodiment, about 20 V or less) is applied to the capacitive structure in order to charge a capacitor. The voltage is removed after the capacitor is charged. The spacing between the anode 20 and the grid 22 is increased utilizing the motion system. The speed at which the spacing is increased is selected so that capacitive structure does not have time to discharge. In one embodiment, these teachings not be limited only to that embodiment, the anode-grid spacing is increased in about 10 μs. Increasing the spacing result in an increased voltage from grid to the anode/dielectric structure. The spacing is increased until the voltage from grid to anode/dielectric is sufficient for a predetermined electron energy for the electrons reaching the target so that a desired x-ray emission is obtained. The time during which the spacing is increased is selected such that the charge in the capacitive structure remains substantially constant. In some embodiments, not a limitation of these teachings, the spacing is increased until the cathode to anode voltage is about 200 kV to 300 kV. In some instances, the field emission (and associated x-ray emission) is subsequently quenched.

In the embodiments including a MOSFET, the MOSFET structure is energized after the anode-grid spacing has been increased and the desired voltage from grid to anode has been obtained. While not deciding to be bound by theory, in one explanation, the inversion layer of the MOSFET structure controls the electrons supply to the field emission; the MOSFET serves as a current source. In that embodiment, the MOSFET structure is de-energized when the when the initial charge on the grid/anode is partially reduced and the grid/anode potential difference is essentially constant.

Figure 4:
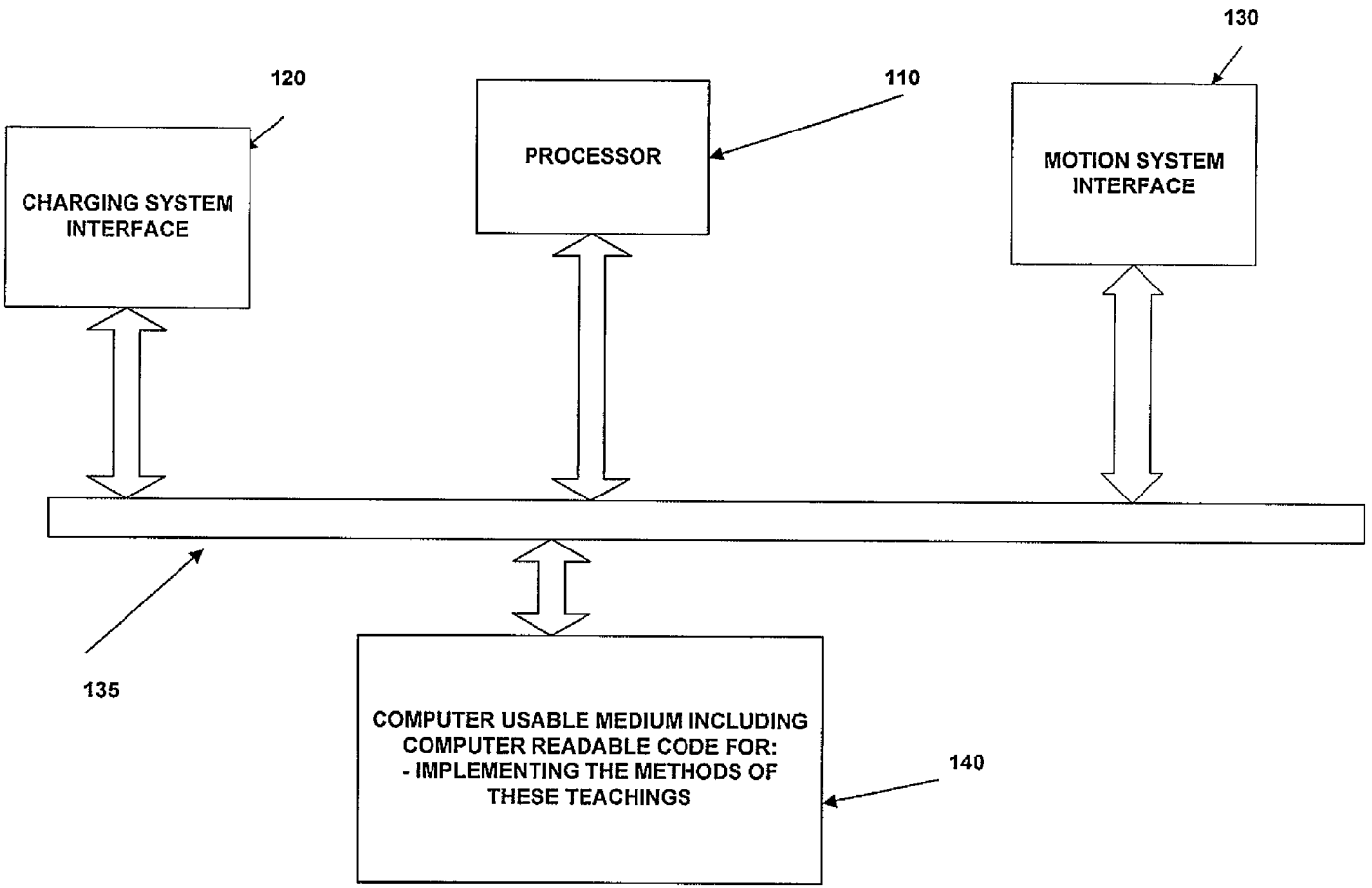
FIG. 4 represents an embodiment of one component of an embodiment of the system of these teachings.

In one embodiment, the charging of the capacitive structure, the operation of the motion system to increase the distance between the anode and the grid, and in some instances, the quenching of the field emission are controlled by a controller. In one instance, shown in FIG. 4, the controller includes one or more processors 110, an interface to the charging system 120, an interface to the motion system 130 and one or more computer usable media 140 having computer readable code embodied therein, the computer readable code causing the one or more processors 110 to perform the functions described herein above. The components of the controller are operatively connected by an interconnection component 135 such as a computer bus.

In another instance, the controller can be a dedicated circuit such as, but not limited to, a field programmable gate array.

Although the exemplary application of the system of these teachings to a micro x-ray source matching described hereinabove, the system of these teachings is capable of a number of other exemplary applications. For example, the above disclosed application can be modified to describe a small ion source. If the cathode in the micro x-ray source application is replaced by an ion source, the charging voltage is reversed in polarity and the anode in the micro x-ray source is replaced by another grid, the system can be used as a small ion source. After the capacitive structure is charged, the ion source is energized and a voltage is placed between the ion source and the first grid so that ions enter the space between the two grids.

In another exemplary application of the system of these teachings, the system including a first conducting surface and a second conducting surface/dielectric can be used for energy storage (see, for example, Design of capacitor batteries for temporary power storage for windmills, presented at the Workshop on next generation Wind Power, May 12, 2010, Troy, N.Y., a copy of which is incorporated by reference herein in its entirety and for all purposes).

In yet another exemplary embodiment of the system of these teachings, the system can be used for very compact accelerators with large fields, for example, these teachings not being limited only to that example, fields of the order of 109 V/m.

For the purposes of describing and defining the present teachings, it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Although the invention has been described with respect to various embodiments, it should be realized these teachings are also capable of a wide variety of further and other embodiments within the spirit and scope of the appended claims.

What is claimed is:

1. An apparatus comprising:

a first conducting structure that acts as a charged particle source of an accelerated charged particle beam;

a second conducting structure;

a grid disposed between the second conducting structure and the first conducting structure; the second conducting structure and the grid forming a capacitive structure;

a charging component configured to charge the capacitive structure; a charging voltage being removed after the capacitive structure is charged; and a motion subsystem configured to effect a displacement between the second conducting structure and the grid after the charging voltage is removed: the displacement increasing a distance between the second conducting structure and the grid; a speed at which the distance is increased is selected such that the charged capacitive structure does not discharge; a resulting distance selected such that a predetermined increased voltage between the second conducting structure and the grid is obtained.

2. The apparatus of claim 1 wherein charged particles are electrons, the first conducting structure comprises a cathode structure; and the apparatus further comprises an energizing component causing electron emission between the cathode structure and the grid.

3. The apparatus of claim 2 wherein the apparatus is an x-ray source; and wherein the second conducting structure comprises an anode structure, and wherein the anode structure comprises materials selected for x-ray emission.

4. The apparatus of claim 3 wherein emission from said materials comprise x-ray line spectra.

5. The apparatus of claim 1 wherein the capacitive structure comprises a dielectric disposed between the second conducting structure and the grid.

6. The apparatus of claim 5 wherein the dielectric is disposed on the second conducting structure.

7. The apparatus of claim 5 wherein the dielectric is disposed on the grid.

8. The apparatus of claim 1 wherein said first conducting structure and said capacitive structure are located in a substantially evacuated enclosure.

9. The apparatus of claim 1 further comprising a controller component configured to control application and removal of a predetermined voltage between the first conducting structure and the grid.

10. The apparatus of claim 9 wherein the controller component comprises:

one or more processors;

interface components operatively connected to said charging component and said motion subsystem; and one or more computer usable media having computer readable code embodied therein, the computer readable code causing the one or more processors to:

apply a predetermined voltage in order to charge the capacitive structure;

remove the predetermined voltage when the capacitive structure is substantially charged; and increase spacing between the grid and the second conducting structure to a predetermined amount in a predetermined time.

11. The apparatus of claim 1 wherein the first conducting structure comprises an ion source; and the second conducting structure comprises another grid.

12. A system comprising:

an array of x-ray sources, each x-ray source from the array of x-ray sources comprising:

an apparatus of claim 1; wherein said first conducting structure comprises a cathode structure and wherein said cathode structure and said capacitive structure are located in a substantially evacuated enclosure;

and wherein the second conducting structure comprises an anode structure and said anode structure comprises materials selected for x-ray emission;

the apparatus further comprising an energizing component accelerating/causing electron emission between the cathode structure and the grid;

a housing in which the array of x-ray sources is enclosed; and a cooling device operatively connected to the housing.

13. The system of claim 12 wherein the capacitive structure in each apparatus comprises a dielectric disposed between the anode structure and the grid.

14. The system of claim 13 wherein the dielectric is disposed on the anode structure.

15. The system of claim 13 wherein the dielectric is disposed on the grid.

16. The system of claim 12 wherein emissions from at least some of said materials comprise x-ray line spectra.

17. A method for enhancing resolution of x-ray images, the method comprising:

providing an array of x-ray sources; each x-ray source from the array of x-ray sources comprising:

an apparatus of claim 1; wherein said first conducting structure comprises a cathode structure and wherein said cathode structure and said capacitive structure are located in a substantially evacuated enclosure;

and wherein the second conducting structure comprises an anode structure and said anode structure comprises materials selected for x-ray emission; wherein emissions from at least some of said materials comprise x-ray line spectra;

the apparatus further comprising an energizing component accelerating/causing electron emission between the cathode structure and the grid;

exposing an object to x-rays from the array of x-ray sources, obtaining an image; and applying techniques selected from at least one of subtraction and phase coherence in order to enhance resolution.

18. A method for obtaining an accelerated charged particle beam, the method comprising:

charging a capacitive structure in a device comprising:

a first conducting structure that acts as a charged particle source of the accelerated charged particle beam;

a second conducting structure;

a grid disposed between the second conducting structure and the first conducting structure; the second conducting structure and the grid forming the capacitive structure;

a charging component configured to charge the capacitive structure; a charging voltage being removed after the capacitive structure is charged; and a motion subsystem configured to effect a displacement between the second conducting structure and the grid;

removing a charging voltage after the capacitive structure is charged;

increasing a distance between the second conducting structure and the grid after removing the charging voltage; a speed at which the distance is increased is selected such that the charged capacitive structure does not discharge; resulting displacement selected such that a predetermined increased voltage between the second conducting structure and the grid is obtained; and causing charged particle emission from the first conducting structure.

19. The method of claim 18 wherein the charged particles are electrons; and wherein causing charged particle emission comprises energizing the first conducting structure/grid.

20. The method of claim 18 wherein the first conducting structure comprises an ion source.

21. The method of claim 18 wherein the capacitive structure comprises a dielectric disposed between the second conducting structure and the grid.

* * * * *